US006365307B1

(12) United States Patent
Markovics

(10) Patent No.: US 6,365,307 B1
(45) Date of Patent: Apr. 2, 2002

(54) APPARATUS AND METHOD FOR ASSESSING A PHOTORECEPTOR

(75) Inventor: James M. Markovics, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/734,971

(22) Filed: Dec. 12, 2000

(51) Int. Cl.[7] ..... G03C 5/00

(52) U.S. Cl. ..... 430/30; 430/34; 430/35; 399/31

(58) Field of Search ..... 430/30, 34, 35; 399/31

(56) References Cited

U.S. PATENT DOCUMENTS

| | | | | |
|---|---|---|---|---|
| 2,904,431 A | | 9/1959 | Moncrieff-Yeates | 96/1 |
| 2,987,660 A | | 6/1961 | Walkup | 317/262 |
| 5,132,627 A | * | 7/1992 | Popovic et al. | 324/452 |
| 5,457,523 A | | 10/1995 | Facci et al. | 355/219 |
| 5,504,383 A | | 4/1996 | Facci et al. | 310/339 |
| 5,510,879 A | | 4/1996 | Facci et al. | 355/219 |
| 5,602,626 A | | 2/1997 | Facci et al. | 399/135 |
| 5,610,689 A | * | 3/1997 | Kamiya et al. | 399/31 |
| 5,777,651 A | | 7/1998 | Facci et al. | 347/123 |
| 5,999,201 A | | 12/1999 | Dalal et al. | 347/115 |

OTHER PUBLICATIONS

"Charging of Electrophotographic Photoreceptors (III)" M. Matsuda, A. Nishida, and S. Matsumoto—Oct. 1992 pp. 307–310.

* cited by examiner

*Primary Examiner*—Mark Chapman
(74) *Attorney, Agent, or Firm*—Perman & Green, LLP

(57) ABSTRACT

An ionic medium, e.g., an ionic liquid, gel-like solid, etc., contacts a photoreceptor, e.g., as used in xerography etc., in order to charge and/or discharge the photoreceptor. A measuring device, e.g., an electrometer or current meter, measures at least one characteristic, e.g., voltage or current, and, if desired, light intensity, of the photoreceptor during or shortly after charging and/or discharging operations.

16 Claims, 3 Drawing Sheets

APPARATUS AND METHOD FOR ASSESSING A PHOTORECEPTOR

CROSS-REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to determining at least one characteristic of a photoreceptor, and more particularly, when the photoreceptor is used for xerography.

2. Description of the Related Art Including Information Disclosed Under 37 CFR 1.97 and 1.98

Most lower-end copiers and printers on the market today use consumer replaceable units (CRU's) to package the parts, such as toner and photoreceptor (PR), which require replacement several to many times through the useful life of the machine. In most of these CRU's, the life limiting element is related to toner, either through finite supply or finite waste toner sump capacity. The photoreceptors have demonstrated an ability to provide multiple CRU lives; in most cases, the failure mode of the photoreceptor is physical wear, either localized, as in scratches or dings, or in approximately uniform wearing away of the charge transport layer (CTL) coating. Refurbishers have built a significant business on the long lives of photoreceptors in CRU's by doing simple inspection of spent CRU's for obvious PR damage, refilling the toner sump and emptying the cleaner sump on those CRU's without obvious damage, and reselling the refurbished cartridge. Without disassembling the CRU and using sophisticated test equipment, the refurbisher has no simple way of assessing his risk of returning a PR which might fail due to having been worn too much. In addition, photoreceptor-only CRUs are now sometimes present in higher-end machines, thereby making in situ photoreader assessment even more desirable to extend useful CRU life.

It is noted that U.S. Pat. Nos. 2,987,660, 5,504,383, 5,602,626, 5,457,523, 5,777,651, and 5,510,879 all show charging a PR, but do not show making measurements. U.S. Pat. No. 2,904,431 shows using alcohol for charging a PR, but no measurements are taken.

It is therefore desirable to have apparatus and method for obtaining the usable time left for a PR to properly function.

BRIEF SUMMARY OF THE INVENTION

Apparatus for use with a photoreceptor comprises an ionic medium for contacting the photoreceptor to permit at least one of the charging and discharging operations of said photoreceptor and measuring circuitry for measuring at least one characteristic of said photoreceptor proximately during at least one of said operations.

A method for use with a photoreceptor comprises performing at least one of charging and discharging operations on the photoreceptor using a ionic medium and measuring at least one characteristic of said photoreceptor proximately during at least one of said operations.

BRIEF DESCRIPTION OF THE SEVERAL VIEWS OF THE DRAWING(S)

DETAILED DESCRIPTION OF THE INVENTION

Figure 1:
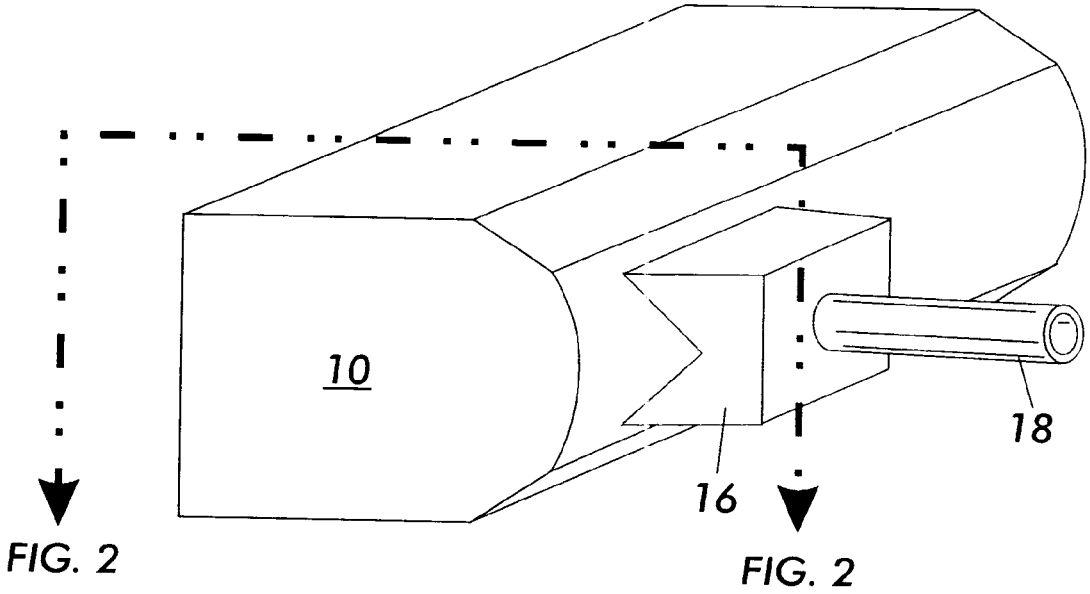
FIG. 1 is an isometric view of the invention.

FIG. 1 shows a CRU 10 having an insulating probe holder 16 (described in detail below) disposed adjacent thererto. A fiber optic probe 18 is held by holder 16.

Figure 2:
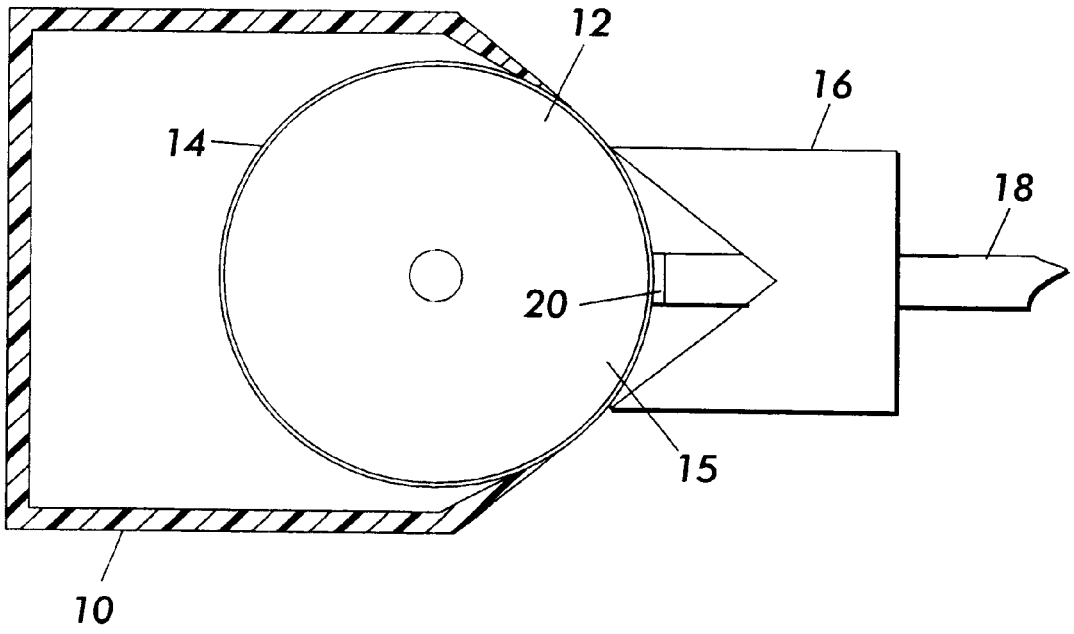
FIG. 2 is a cross-sectional view of the invention taken along lines 2—2 of FIG. 1.

FIG. 2 shows CRU 10 having a drum 12 disposed therein. As known in the art, also disposed in drum 10 are a charge element, exposure window, and clearing station (none shown). Drum 12 is made of a conducting material, which is normally grounded, and has a photoreceptor coating 14 of a thickness of between about 5 and 60 $\mu$m, typically about 25 $\mu$m, around its periphery. Coating 14 may be made of any photoconductor material. This may include, for example, photoconductive insulators such as vitreous or amorphous selenium as well as photoconductive insulators such as anthracene, sulfur, and the like, and film-forming binder materials containing photoconductive crystalline or solid materials such as, for example, the sulfides, oxides, and selenides of zinc, cadmium, and the like supported in organic film-forming binders. Drum 12 has a portion of its coated surface projecting through a port 15. This is normally the image transfer port, since it is normally larger, but the exposure access port can also be used for the measurements in accordance with the present invention.

Insulating probe holder 16 is disposed proximate CRU 10 in order to place one end of fiber optic probe 18 perpendicular to, and within a small distance, e.g. from between about 0.1 to 2 mm, typically about 1 mm, from, the projecting surface of coating 14. As shown, holder 16 has a V-shape, but other shapes, e.g., a U-shaped, etc., can be used. It is made of a polymer, but any insulating material can be used. Probe 18 has another end (not shown) connected to a light source (not shown) and a measurement device (not shown in FIG. 1). Disposed between coating 14 and probe 18 is ionic medium 20, e.g., an ionic liquid such as dilute aqueous KCl, gel-like solid, combinations thereof, etc. In particular, ionic water, or water-gel bead, ionic conductive transparent polymer film, a water dampened pod of dense open cell foam, can all be used.

Figure 3:
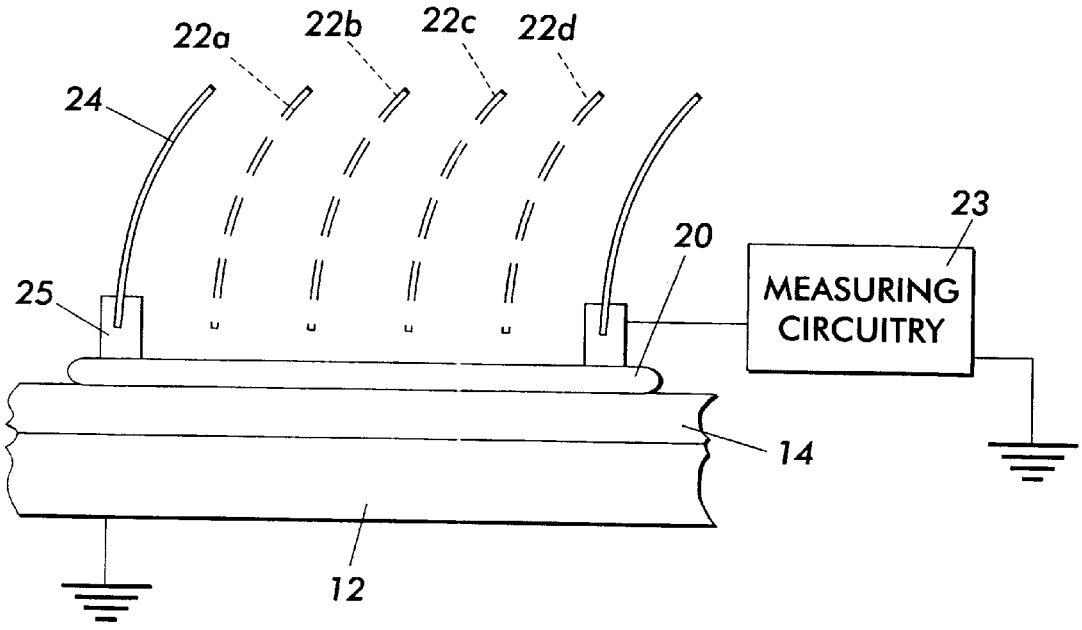
FIG. 3 is an enlarged cross-sectional view.

FIG. 3 shows that probe 16 comprises a bundle of fiber optic light pipes 22*a,* 22*b,* 22*c,* and 22*d* disposed within bundle sheath 24, which can be made of e.g., a flexible plastic, a conductor such as a metal, etc. Although only four fibers 22 are shown, it will be appreciated that normally there are many more, e.g., about 1000 fibers. Bundle sheath 24 is secured within a conducting, e.g., a metal, sheath holder 25.

Figure 4:
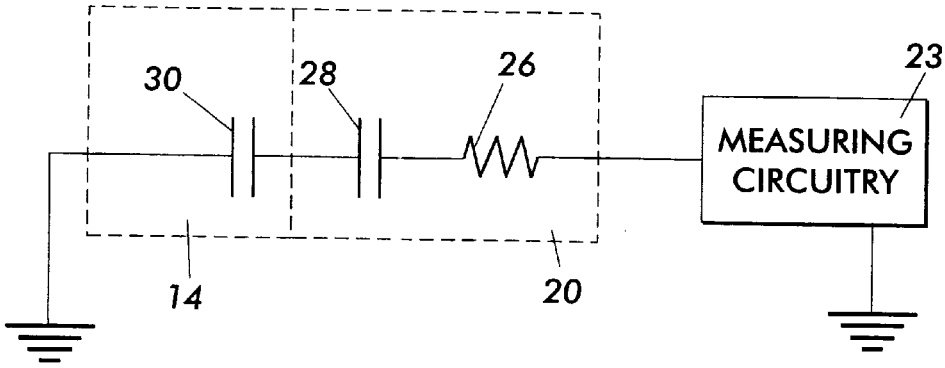
FIG. 4 shows an equivalent circuit of the invention.

In FIG. 4, a grounded measuring circuitry 23 comprises a high impedance electrometer or voltage meter (not shown) and a current source (not shown), or a current meter (not shown) and a voltage source (not shown), or combinations thereof, all as known in the art. Circuitry 23 is coupled to resistor 26 which represents the resistance of the ionic medium 20. In turn, resistor 26 is connected to capacitor 28 which represents the capacitance of the ionic medium 20. Capacitor 28 is connected to capacitor 30 which represents the capacitance of the photoreceptor 14. The capacitance of capacitor 28, being essentially the capacitance of a molecular dipole bilayer (not shown) at the ionic medium 20-photoreceptor 14 interface, is normally much greater than the capacitance of capacitor 30. Thus, the equivalent series capacitance of these two capacitors will be essentially determined by the photoreceptor capacitor 30. This makes possible the measurement of the capacitance of capacitor 30.

The QV (charge-voltage) characteristic for the PR coating 14 can be measured, either by measuring the charge drawn by the circuit to achieve an applied voltage, or by measuring the voltage resulting from connecting a capacitor of known charge and capacitance across the photoreceptor 14. These measurements are done proximately in time (during or shortly thereafter, e.g., 0 to 5 seconds, of the charging or discharging operations) depending upon the response time of circuitry 23, photoconductor 14, and ionic medium 20. The dielectric thickness of the photoconductive coating 14 can be determined from the maximum slope of voltage as a function of the applied change. Other characteristics could also be deduced, such as the dark decay and depletion charge, both of which can be used as indicators of useable life.

If more detailed information concerning the photoresponse of the PR 14 in the CRU 10 were desired, then the medium 20 above could be either an ionic conducting transparent elastomer polymer film or ionic liquid bead at the end of a fiber bundle optical head of perhaps one half to several $cm^2$ area. For example, a circle-to-line fiber bundle might be used to provide a circular aperture for light input to yield a uniform narrow line exposure the full length of the photoreceptor 14, perhaps one or two mm in width, enabling an average sampling measurement along the length of the photoreceptor 14. Shorter or smaller geometry probes used in several positions on the photoreceptor 14 could provide information on wear and electrical performance uniformity. The ionically conducting liquid or transparent conducting elastomer 20, conformable to the radius of curvature of the rigid photoreceptor 14, provides intimate contact of well defined area. The external circuitry would include, in addition to charge and voltage measurement, provision for control, and perhaps measurement, of light exposure through the light pipe 18. At a minimum, such a system would enable in-situ measurement of dielectric thickness, depletion charge (charge density corresponding to zero voltage on photoreceptor 14), dark decay (magnitude of the voltage reduction in the dark a selected time after charge is applied), $V_H$ (voltage in the dark after charging), $V_L$ (image voltage from a fixed exposure), and $V_R$ (residual voltage after exposure to erase light).

While the present invention has been particularly described with respect to preferred embodiments, it will be understood that the invention is not limited to these particular preferred embodiments, the process steps, the sequence, or the final structures depicted in the drawings. On the contrary, it is intended to cover all alternatives, modifications, and equivalents as may be included within the spirit and scope of the invention defined by the appended claims. In addition, other methods and/or devices may be employed in the method and apparatus of the instant invention as claimed with similar results.

What is claimed is:

1. Apparatus for use with a photoreceptor, said apparatus comprising:

an ionic medium for contacting the photoreceptor to permit at least one of charging and discharging operations of said photoreceptor; and measuring circuitry for measuring at least one characteristic of said photoreceptor proximately during at least one of said operations.

2. The apparatus of claim 1, further comprising said photoreceptor.

3. The apparatus of claim 1, wherein said ionic medium comprises an ionic liquid.

4. The apparatus of claim 3, wherein said ionic medium further comprises a gel-like solid.

5. The apparatus of claim 1, wherein said measuring device comprises an electrometer.

6. The apparatus of claim 1, wherein said measuring circuitry measures said characteristic proximately during said charging operation.

7. The apparatus of claim 6, wherein said measuring circuitry also measures said characteristic proximately during said discharging operation.

8. The apparatus of claim 1, wherein said measuring circuitry measures said characteristic during said discharging operation.

9. The apparatus of claim 1, wherein said characteristic comprises voltage.

10. The apparatus of claim 1, wherein said characteristic comprises current.

11. The apparatus of claim 1, wherein said characteristic comprises light intensity.

12. A method for use with a photoreceptor, said method comprising:

performing at least one of charging and discharging operations on the photoreceptor using an ionic medium; and measuring at least one characteristic of said photoreceptor proximately during at least one of said operations.

13. The method of claim 12, wherein said measuring step is performed proximately during charging.

14. The method of claim 13, wherein said measuring step is also performed proximately during discharging.

15. The method of claim 12, wherein said ionic medium comprises an ionic liquid.

16. The method of claim 12, wherein said ionic medium comprises a gel-like solid.

* * * * *